US007810416B2

(12) United States Patent
Cutler et al.

(10) Patent No.: US 7,810,416 B2
(45) Date of Patent: Oct. 12, 2010

(54) LOCKABLE TORQUE-LIMITING DRIVER AND METHOD

(75) Inventors: Brian James Cutler, Rowland Heights, CA (US); Charles Parkin Davis, Torrance, CA (US)

(73) Assignee: California Torque Products, Inc., Chino, CA (US)

( * ) Notice: Subject to any disclaimer, the term of this patent is extended or adjusted under 35 U.S.C. 154(b) by 0 days.

(21) Appl. No.: 12/174,864

(22) Filed: Jul. 17, 2008

(65) Prior Publication Data

US 2009/0260490 A1 Oct. 22, 2009

Related U.S. Application Data

(62) Division of application No. 11/279,752, filed on Apr. 14, 2006, now Pat. No. 7,487,700.

(60) Provisional application No. 60/674,785, filed on Apr. 26, 2005.

(51) Int. Cl.
*B25B 23/143* (2006.01)

(52) U.S. Cl. ..... 81/467; 81/475

(58) Field of Classification Search ..... 81/467, 81/473–475, 477

See application file for complete search history.

(56) References Cited

U.S. PATENT DOCUMENTS

| | | | | | |
|---|---|---|---|---|---|
| 2,797,564 | A * | 7/1957 | Bonneau et al. | ..... | 464/38 |
| 3,651,718 | A * | 3/1972 | Thomasian | ..... | 81/480 |
| 5,746,298 | A * | 5/1998 | Krivec et al. | ..... | 192/48.3 |
| 6,076,439 | A * | 6/2000 | Dzieman | ..... | 81/473 |
| 6,095,020 | A * | 8/2000 | Rinner | ..... | 81/475 |
| 6,155,147 | A * | 12/2000 | Dzieman | ..... | 81/473 |
| 6,640,674 | B1 * | 11/2003 | Rinner et al. | ..... | 81/475 |
| 7,166,040 | B2 * | 1/2007 | Hoffman et al. | ..... | 473/334 |
| 7,186,190 | B1 * | 3/2007 | Beach et al. | ..... | 473/335 |
| 7,272,999 | B2 * | 9/2007 | Cutler et al. | ..... | 81/475 |
| 2006/0179981 | A1 * | 8/2006 | Cutler et al. | ..... | 81/475 |

* cited by examiner

*Primary Examiner*—David B Thomas
(74) *Attorney, Agent, or Firm*—Italia IP; James A. Italia

(57) ABSTRACT

A lockable torque-limiting driver that includes, a body, a sleeve, a shaft carried by the body for rotation relative thereto and having a fastener-engaging tip at one end that projects from the body, a torque-limiting mechanism coupled to the shaft and housed within said body, a torque-adjusting mechanism within the body and coupled to the torque-limiting mechanism for adjusting the torque-limiting mechanism to a desired torque value, a torque-locking mechanism operably coupled with the torque-adjusting mechanism and the body or the sleeve for preventing movement of the torque-determining means and locking the settable torque-limiting driver at the desired torque value.

9 Claims, 17 Drawing Sheets

LOCKABLE TORQUE-LIMITING DRIVER AND METHOD

CROSS-REFERENCE TO RELATED APPLICATION

This Divisional Application in filed under 37 CFR 1.53(b) and claims the benefit of the filing date under 35 USC 121 of U.S. Non-Provisional application Ser. No. 11/279,752, filed Apr. 14, 2006 now U.S Pat. No. 7,487,700, which claimed the benefit under 35 USC 119(e) of the filing date of U.S. Provisional Application Ser. No. 60/674,785, filed Apr. 26, 2005.

BACKGROUND

This application relates generally to driving tools such as screwdrivers, nut drivers, bolt drivers, wrenches and the like wherein the amount of torque that the tool can apply to a given fastener is limited to a settable value. More specifically, this application relates to a torque locking mechanism usable in said tools that allows a fine range of torques for a given tool and prevents the inadvertent change of the torque setting once set.

Torque settable drivers as described above are well known in the art. This application relates to drivers that are designed for specific uses and thus a lockable torque value is desirable. The need for a lockable torque-limiting driver that can drive a given fastener at a desired torque value is useful in a variety of fields including sporting goods, electronics and computer assembly, and any other use wherein specific tolerances are required. However, it would be desirable if there was a tool that would allow for a fine range of torque setting such that a given tool could be effectively locked into a variety of specific torque settings. It would also be desirable for such a tool to be low-cost and suitable for mass production without sacrificing precision.

SUMMARY

This application discloses a settable torque-limiting driver that is economical to produce, of simple construction and capable of mass production, but also capable of being locked in a variety of precise torque settings.

In particular, this application discloses a lockable torque-limiting driver that includes gripping means, a body, a sleeve, a shaft carried by the body for rotation relative thereto and having a fastener-engaging tip at one end that projects from the body, torque-limiting means coupled to said shaft and housed within said body, torque-adjusting means within said body and coupled to said torque-limiting means for adjusting the torque-limiting means to a desired torque value, torque-locking means operably coupled with said torque-adjusting means and said body for preventing movement of said torque-determining means and locking the settable torque-limiting driver at the desired torque value.

In another embodiment, this application discloses a lockable torque-limiting driver that includes gripping means, a body, a sleeve, a shaft carried by the body for rotation relative thereto and having a fastener-engaging tip at one end that projects from the body, torque-limiting means coupled to said shaft and housed within said body, torque-adjusting means within said body and coupled to said torque-limiting means for adjusting the torque-limiting means to a desired torque value, torque-locking means operably coupled with said torque-adjusting means and said sleeve for preventing movement of said torque-determining means and locking the settable torque-limiting driver at the desired torque value.

In a further embodiment, this application discloses a method for locking a settable torque-limiting driver at a desired torque value by providing a torque-limiting mechanism coupled to a shaft and housed within a body, setting a torque-adjusting mechanism coupled to said torque-limiting mechanism, and engaging the torque-adjusting mechanism with a torque-locking mechanism.

In yet a further embodiment, this application discloses a golf club weight attachment system comprising: a golf club capable of being adjusted by securing screwably attachable weights in defined positions at a desired torque setting on said club; and, a lockable torque-limiting driver for securing said weights to said golf club at a defined torque setting wherein the driver comprises a body; a sleeve carried by said body; a shaft carried by said body for rotation relative thereto and having a weight-engaging tip at one end that projects from the body for screwably attaching said weights; torque-limiting means coupled to said shaft and housed within said body; torque-adjusting means within said body and coupled to said torque-limiting means for adjusting the torque-limiting means to the desired torque value; and, torque-locking means operably coupled with said torque-adjusting means and said body or said sleeve for preventing movement of said torque-determining means and locking the settable torque-limiting driver at the desired torque value such that the weights are attached to the golf club at the desired torque value.

BRIEF DESCRIPTION OF THE DRAWINGS

The drawings, when considered in connection with the following description, are presented for the purpose of facilitating an understanding of the subject matter sought to be protected.

FIG. 1A is a top plan view of the sleeve in FIG. 10;

DETAILED DESCRIPTION

Figure 1A:
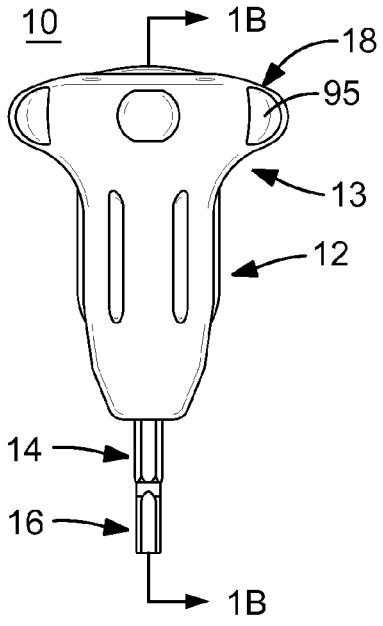
FIG. 1A is a front elevational view of a lockable torque-limiting driver.

Referring to FIGS. 1A-3C, shown therein and generally designated by the reference character 10 is a lockable toque-limiting driver constructed in accordance with the following description. The driver 10 includes a body 12 having an elongated shaft 14 with a fastener-engaging portion 16 extending from one end thereof. At the other end, the driver 10 is provided with a cap member 18.

Figure 1B:
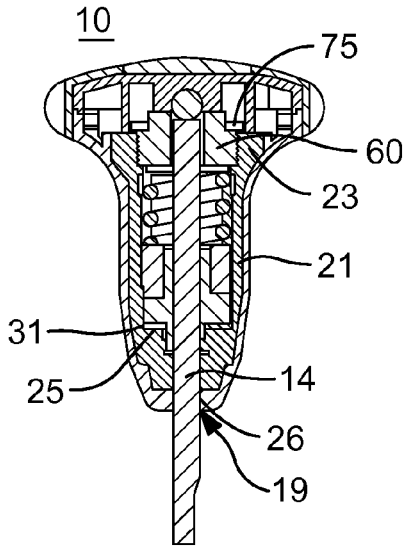
FIG. 1B is a sectional view of the driver taken generally along the line 1B-1B in FIG. 1A showing a first embodiment of the locking mechanism.
Figure 5:
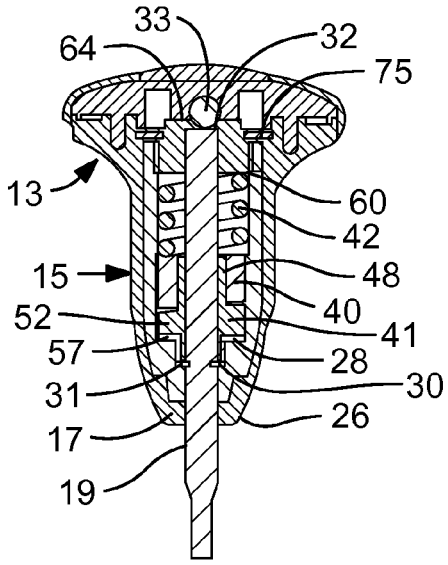
FIG. 5 is a sectional view of the driver showing the first embodiment of the locking mechanism of FIG. 1B taken generally along the line 5-5 in FIG. 4.
Figure 12:
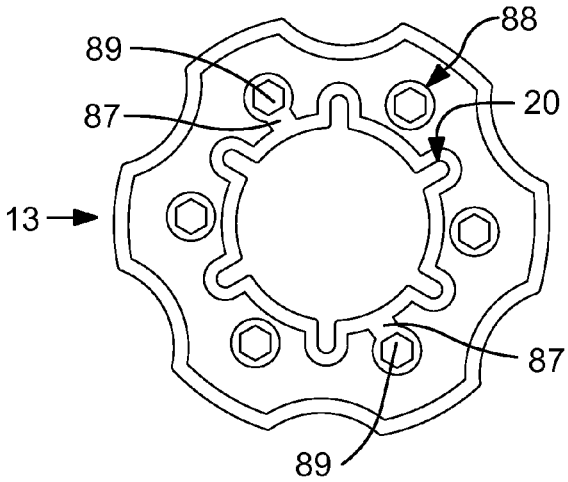
FIG. 12 is a top plan view of the generally circular member of the body of the driver of FIGS. 1C and 2C, isolated to show its details.

As may be seen more clearly in FIGS. 1B and 5, the body 12 is comprised of a generally circular upper member 13 and a hollow, generally cylindrical stem portion 15 with a tapered hexagonal shaped in transverse cross section end wall 17 terminating at its end with axial bore 19 formed therethrough. The inner surface of circular member 13 is provided with a plurality of circumferentially spaced channels 20 (FIG. 12).

Figure 8:
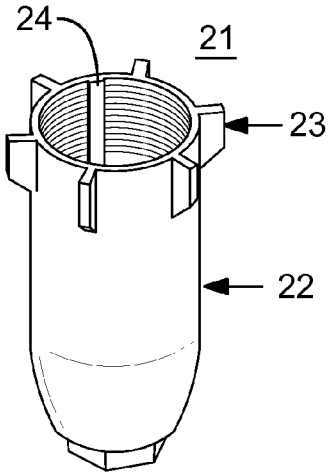
FIG. 8 is perspective view of the sleeve of FIGS. 1C and 2C.
Figure 9A:
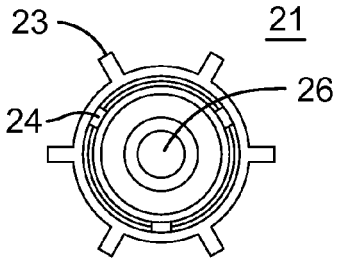
FIG. 9A is a top plan view of the sleeve in FIG. 8.
Figure 9B:
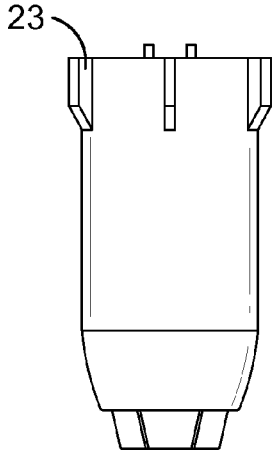
FIG. 9B is a side elevational view of the sleeve in FIG. 8.
Figure 9C:
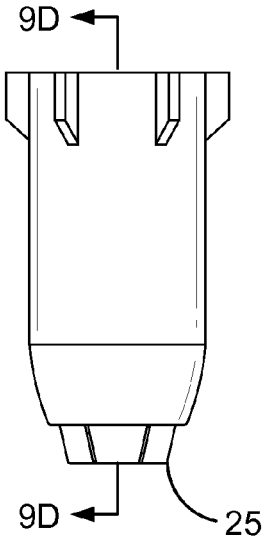
FIG. 9C is a 90° side elevational view of the sleeve in FIG. 9B.
Figure 9D:
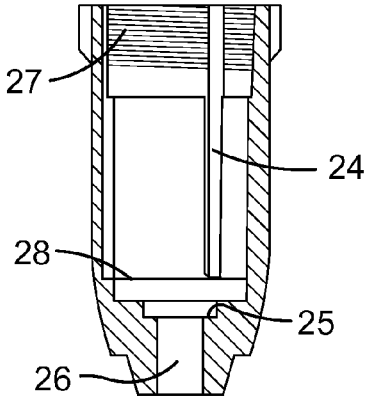
FIG. 9D is a sectional view of the sleeve taken generally along the line 9D-9D in FIG. 9C.
Figure 21:
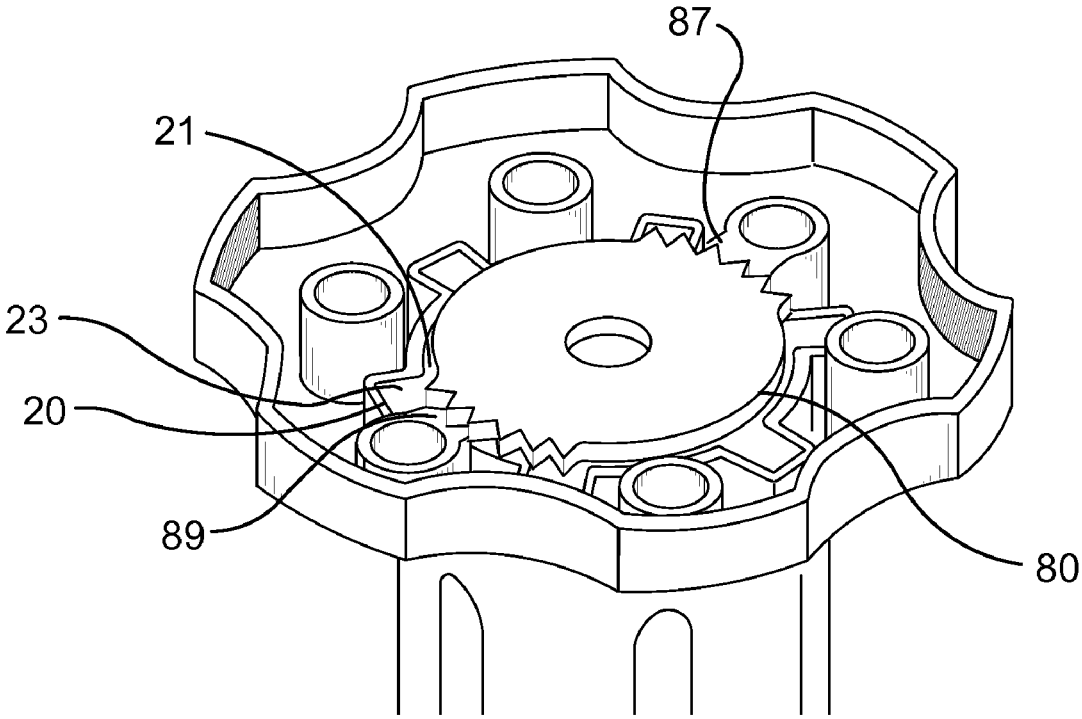
FIG. 21 is a perspective view showing the locking mechanism of the driver of FIG. 2B.

Referring to FIG. 1B and in particular FIGS. 8-9D, the driver 10 includes a sleeve 21 having an elongated, hollow, generally cylindrical body 22 with circumferentially spaced outwardly projecting flanges 23 positioned to be received in the channels 20 (FIG. 21). Formed along the inner surface of the sleeve 21, at circumferentially spaced locations, is a plurality of longitudinally extending channels 24 (FIGS. 9A and 9D). The cylindrical body 22 has a tapered hexagonal shaped in transverse cross section end wall 25 with an axial bore 26 formed therethrough. The inner surface of sleeve 21 includes threads 27 at its upper and open end (FIGS. 8 and 9D). During assembly, sleeve 21 is coaxially received in the stem portion 15 of the driver, with hexagonally shaped sleeve end wall 25 mateably seated in the hexagonally shaped body end wall 17, (FIG. 1B) and flanges 23 mateably received in the channels 20 (FIGS. 1B and 21) thereby preventing rotation of sleeve 21 relative to body 12.

Figure 2A:
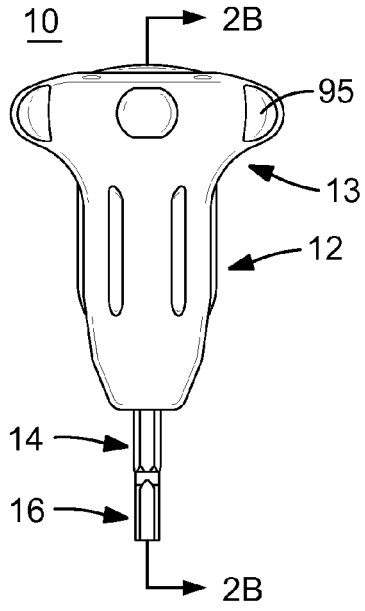
FIG. 2A is a front elevational view of a lockable torque-limiting driver.
Figure 2B:
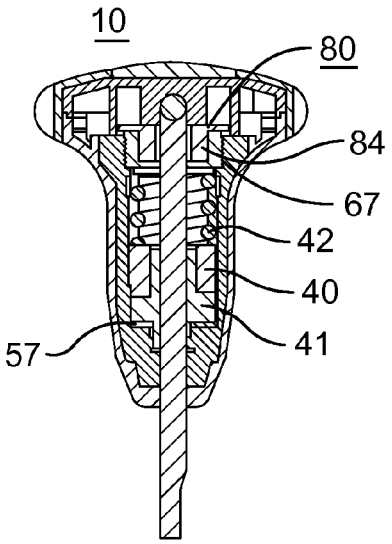
FIG. 2B is a sectional view of the driver taken generally along the line 2B-2B in FIG. 2A showing a second embodiment of the locking mechanism.
Figure 2C:
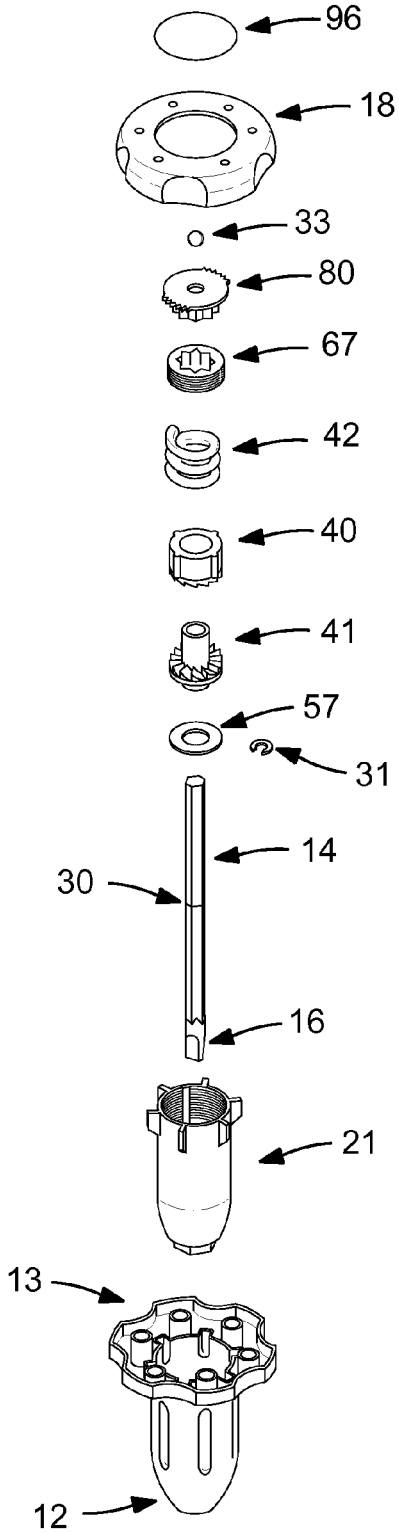
FIG. 2C is an exploded view of the driver of FIG. 2A.

As shown in FIGS. 2C and 5, the driver 10 includes an elongated shaft 14 with a fastener-engaging portion 16 at one end. The shaft portion above the engaging portion is hexagonal shaped in transverse cross section. Intermediate to its ends, shaft 14 includes a circumferential groove 30, operably configured to receive a retaining ring 31 (FIGS. 2C and 5). At the end opposite of the fastener-engaging portion 16, the shaft 14 includes a bearing end face 32 configured for engagement with a ball bearing 33. During assembly, the shaft 14 is passed through aligned bores 19 and 26 in the driver stem 15 and sleeve 21 respectively, with the retaining ring 31 seated on the inner surface of sleeve end wall 25 (FIG. 5).

Figure 6:
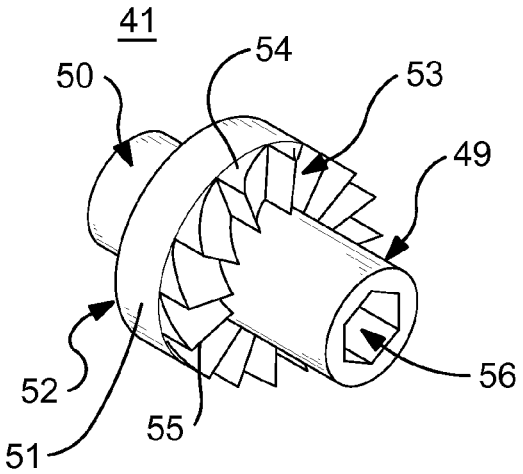
FIG. 6 is a perspective view of the rotational cam of FIGS. 1C, 2C, and 3C.
Figure 7:
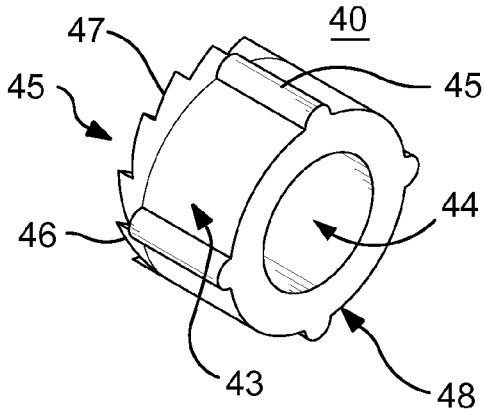
FIG. 7 is a perspective view of the non-rotational cam of FIGS. 1C, 2C, and 3C.

Referring to FIGS. 5-7, the driver 10 includes torque-limiting means, which may comprise an upper non-rotational cam 40, a lower rotational cam 41, and a compression spring 42. More particularly, upper cam 40 includes an annular body 43 and a cylindrical bore 44 formed axially therethrough. On the outer surface of annular body 43 are circumferentially spaced outwardly projecting splines 45. The upper cam 40 has an upper face 48 and a lower face comprised of circumferentially spaced teeth 45, each having a sloping face 46 and an axial face 47. The lower cam 41 includes an elongated cylindrical portion 49 at one end and an elongated location boss portion 50 at the other. Intermediate and integral with the two portions 49 and 50 is a radially extending annular body 51 that includes a lower face 52 and an upper face comprised of circumferentially spaced teeth 53, each having a sloping face 54 and an axial face 55. A hexagonal bore 56 dimensioned to mateably receive shaft 14 is formed through the lower cam 41.

Referring to FIGS. 2B, 2C and 5, during assembly, the lower cam 41 is fitted over the shaft 14 within the sleeve 21 with the lower face 52 seated on a thrust washer 57, which is seated on the sleeve wall 28. When assembled, the hexagonal bore 56 acts in concert with the hexagonal shaft 14 to prevent rotation of the shaft 14 relative to lower cam 41. The upper cam 40 is then fitted down coaxially over the upper end of shaft 14 and within sleeve 21 such that the outwardly projecting splines 45 are mateably received by the longitudinal channels 24 on the inner surface of the sleeve (FIGS. 8A and 9D) and the teeth 45 of the upper cam are mateably engaged with the teeth 53 of the lower cam 41. In such an orientation, the upper cam 40 is prevented from rotation relative to the sleeve 21. And the relative rotation of the upper and lower cams 40 and 41 is prevented in one direction due to the engagement of the axial faces 47 of the teeth 45 with the axial faces 55 of the teeth 53 of the of the upper and lower cams respectively. However, relative rotation of the upper and lower cams 40 and 41 is provided in the opposite direction due to the engagement of the sloping faces 46 of the teeth 45 with the sloping faces 54 of the teeth 53 of the upper and lower cams respectively. Lastly, the torque-limiting means is completed by coaxially fitting the compression spring 42 over the upper end of the shaft 14, within the sleeve 21, and seated on the upper face 48 of the upper cam 40.

Figure 1C:
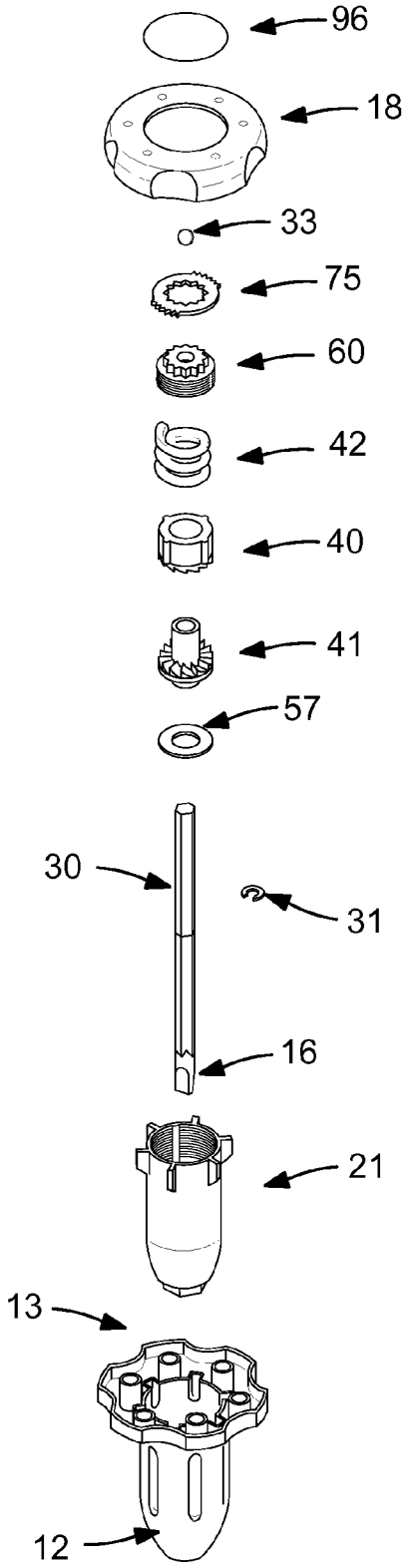
FIG. 1C is an exploded view of the driver of FIG. 1A.
Figure 13:
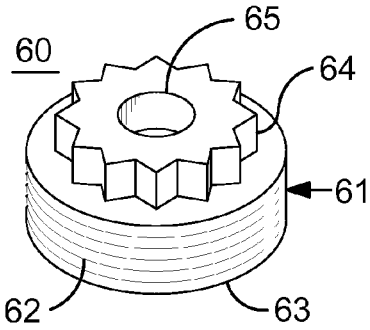
FIG. 13 is a perspective view of the adjustment plug of FIG. 1C.
Figure 13A:
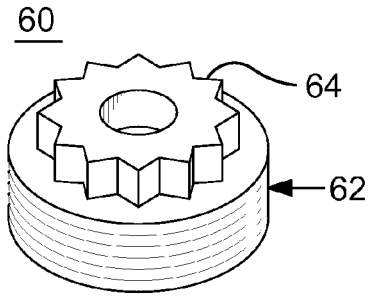
FIG. 13A is an additional perspective view of the adjustment plug of FIG. 1C.
Figure 13B:
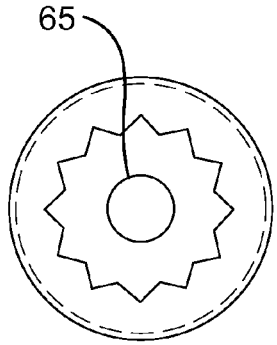
FIG. 13B is a top plan view of the adjustment plug of FIG. 1C.
Figure 13C:
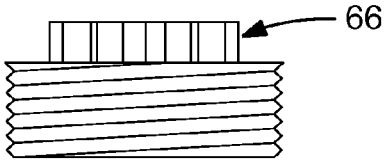
FIG. 13C is a side elevational view of the adjustment plug of FIG. 1C.
Figure 13D:
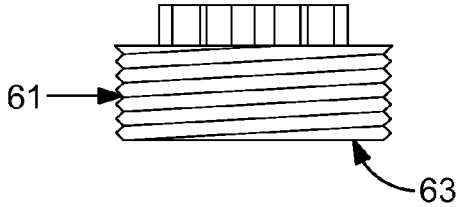
FIG. 13D is a 90° side elevational view of the adjustment plug of FIG. 13C.
Figure 17:
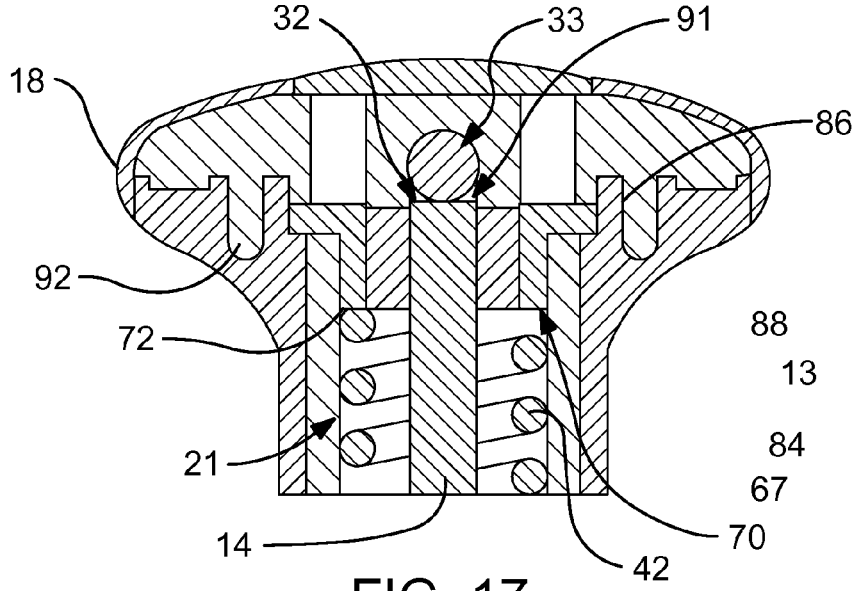
FIG. 17 is a fragmentary sectional view along the line similar to the view in FIG. 5 showing the second embodiment of the locking mechanism of the driver of 2B.
Figure 18:
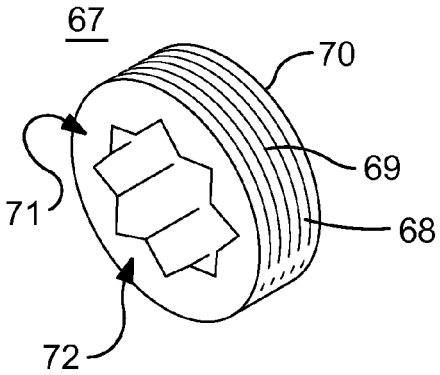
FIG. 18 is a perspective view showing the adjustment plug of the driver of FIGS. 3B and 3C.
Figure 18A:
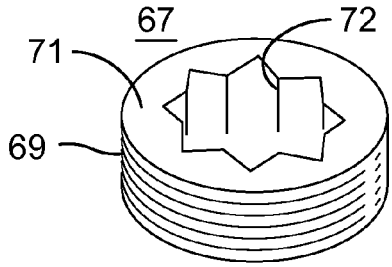
FIG. 18A is an additional perspective view of the adjustment plug of FIGS. 2C and 3C.
Figure 18C:
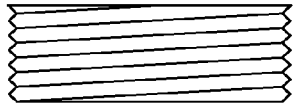
FIG. 18C is a side elevational view of the adjustment plug of FIGS. 2C and 3C.
Figure 18B:
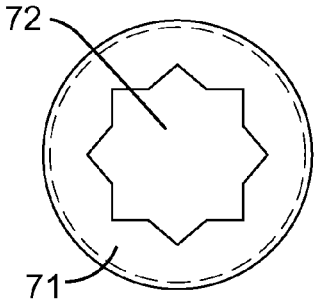
FIG. 18B is a top plan view of the adjustment plug of FIGS. 2C and 3C.
Figure 18D:
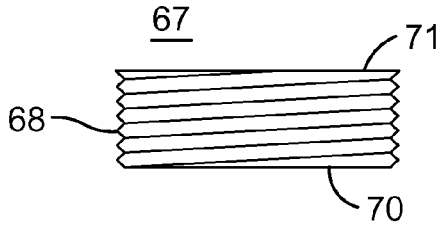
FIG. 18D is a 90° side elevational view of the adjustment plug of FIG. 18C.

The driver 10 includes a torque-adjustment means, which comprises an annular adjustment plug. Two embodiments are described. The first embodiment is shown in FIGS. 1B and 1C, and in particular FIGS. 13-13D. Here the adjustment plug 60 has an annular body 61 with an externally threaded surface 62, a lower end face 63, an upper end face 64 and a cylindrical axial bore 65 therethrough. The upper end face 64 is further characterized by an elongated key structure 66, in this embodiment, a twelve point star formation. The second embodiment of the adjustment plug is shown in FIGS. 2B, 17 and in particular FIGS. 18-18D. Here the adjustment plug 67 has an annular body 68 with an externally threaded surface 69, a lower end face 70, an upper end face 71, and a keyway structure 72 therethrough, in this embodiment, an octagonal bore. During assembly, the adjustment plug 60 or 67 is fitted coaxially over the upper end of the shaft 14, and threadedly engaged in the upper open end of the sleeve 21, for bearing against the upper end of the compression spring 42. The extent to which the adjustment plug 60 or 67 is threaded into the sleeve 21 controls the amount of compression on the spring 42, which, in turn, controls the force with which the upper cam 40 is driven into engagement with the lower cam 41. Thus, the limiting torque required to effect the relative rotation of the upper and lower cam can be set to a desired torque value. To effect the threading of the adjustment plug to the desired position, a socket wrench or the like can be used to engage the key or keyway structure, 66 and 72 respectively.

Figure 14:
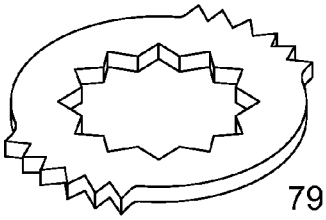
FIG. 14 is a perspective view of the locking plate of FIG. 1C.
Figure 14A:
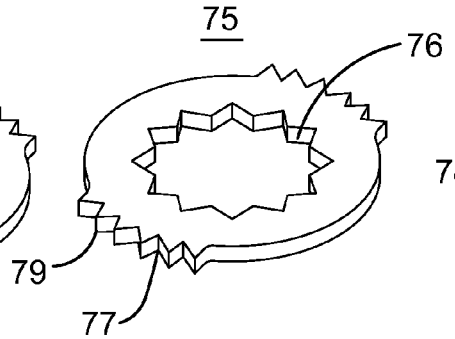
FIG. 14A is an additional perspective view of the locking plate of FIG. 1C.
Figure 14B:
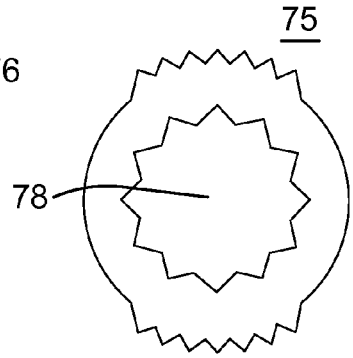
FIG. 14B is a top plan view of the locking plate of FIG. 1C.
Figure 14C:
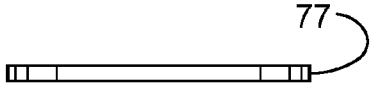
FIG. 14C is a side elevational view of the locking plate of FIG. 1C.
Figure 14D:
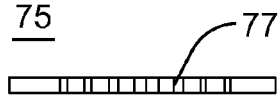
FIG. 14D is a 90° side elevational view of the locking plate of FIG. 14C.
Figure 15:
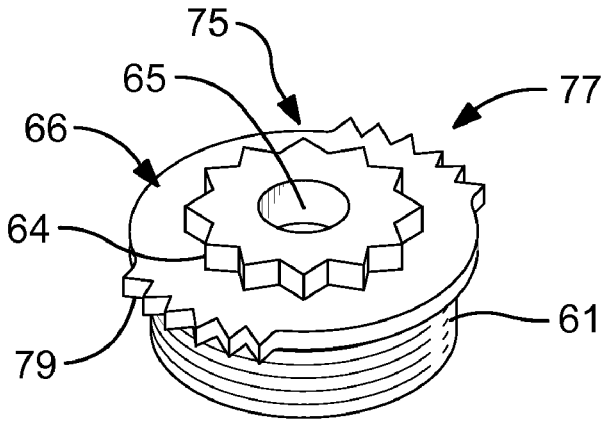
FIG. 15 is a perspective view showing the coupling of the adjustment plug and locking plate of the driver of FIG. 1B.
Figure 16:
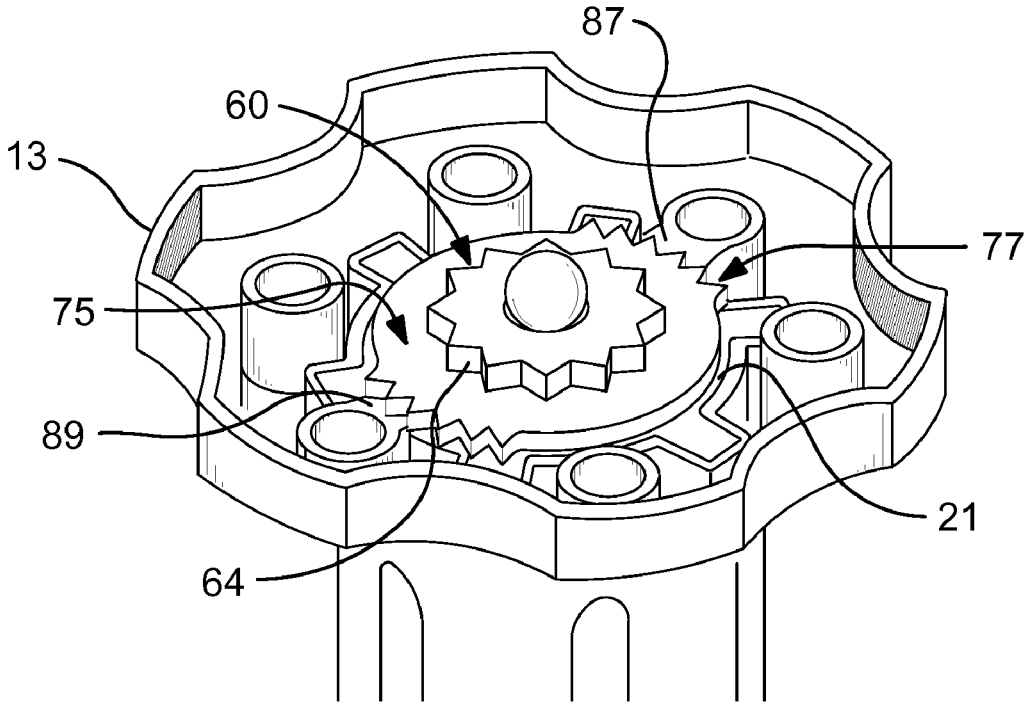
FIG. 16 is a perspective view of the locking mechanism of the driver of FIG. 1B.
Figure 19:
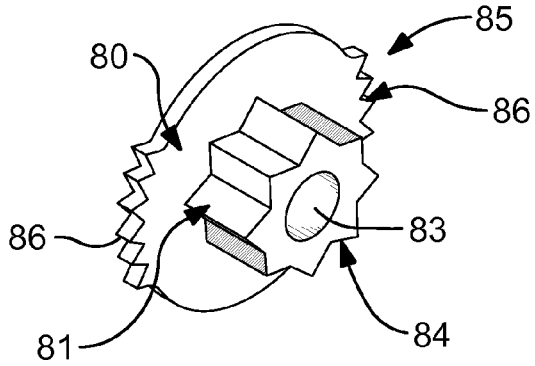
FIG. 19 is a perspective view showing the locking plate of the driver of FIG. 2C.
Figure 19A:
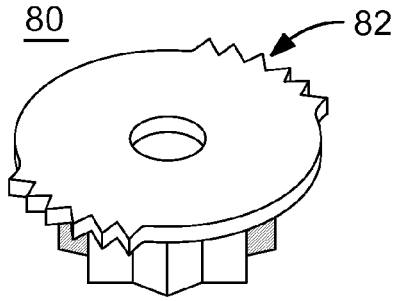
FIG. 19A is an additional perspective view of the locking plate of FIG. 2C.
Figure 19B:
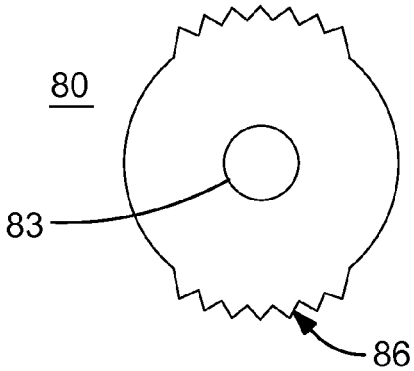
FIG. 19B is a top plan view of the locking plate of FIG. 2C.
Figure 19C:
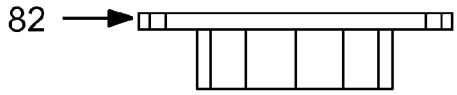
FIG. 19C is a side elevational view of the locking plate of FIG. 2C.
Figure 19D:
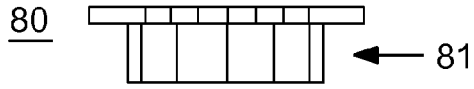
FIG. 19D is a 90° side elevational view of the locking plate of FIG. 19C.
Figure 19E:
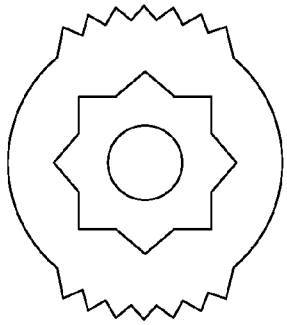
FIG. 19E is a bottom plan view of the locking plate of FIG. 2C.
Figure 20:
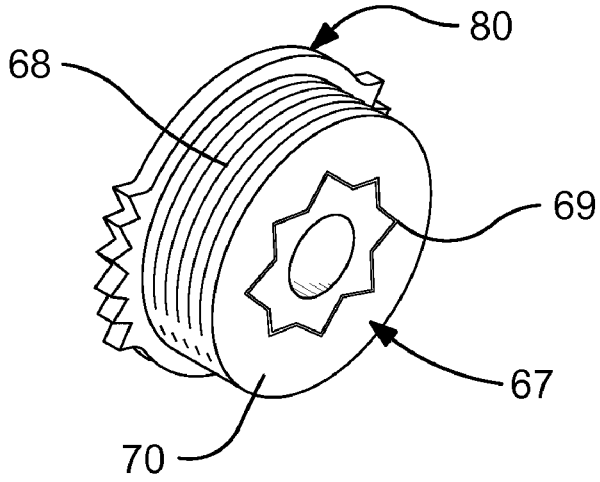
FIG. 20 is a perspective view showing the coupling of the adjustment plug and locking plate of the driver of FIG. 2B.

To maintain the desired torque value, the driver 10 includes a torque-locking means, which comprises a locking plate coupled with the adjustment plug and the driver body to prevent the inadvertent movement of the adjustment plug. Again, two embodiments of the locking plate are described to coincide respectively with the two previously described adjustment plug embodiments. The first embodiment is shown in FIGS. 1B, 5 and in particular FIGS. 14-14D. The locking plate 75 has a generally diamond shape and includes an adjustment plug-engaging portion 76 and a body-engaging portion 77. The plug-engaging portion 76 is characterized by a bored keyway structure 78, in this embodiment, a twelve point star formation to mateably receive the adjustment plug 60 (FIGS. 15 and 16). The body-engaging portion 77 is characterized by serrations 79 located at opposite ends of the plate 75, in this embodiment, six serrations per end. The second embodiment of the locking plate is shown in FIGS. 1B, 17, 21, and in particular FIGS. 19-19D. Here the locking plate 80 is generally T-shaped and includes an adjustment plug-engaging portion 81, a body engaging portion 82, and a cylindrical bore 83 formed axially therethrough. The plug-engaging portion 81 is characterized by an elongated key structure 84, in this embodiment, a twelve point star formation to mateably receive the adjustment plug 67 (FIGS. 17 and 20). The body-engaging portion 85 is characterized by serrations 86 located at opposite ends of the plate 80, in this embodiment, six serrations per end. To receive the body-engaging portions of the locking plates 75 and 80, the body 12 of the driver 10, and in particular the upper surface of the generally circular upper member 13, includes locking plate-engagement portions 89 (FIG. 12). In the embodiment shown in FIG. 12, the locking plate-engagement portions 89 include serrations 87 which are shown integral with the cap location bores 88 to receive the body-engagement portions 77 and 82 respectively (FIGS. 16 and 21). In FIG. 12, the locking plate-engagement serrations 87 are shown integral with only two of the cap location bores 88, but it should be appreciated that the engagement serration may be associated with the other cap location bores for even finer adjusting and locking means.

Referring to FIGS. 1B, 1C and 16, during assembly of the first embodiment of the torque-locking means, locking plate 75 is fitted coaxially over the upper end of shaft 14, the bored keyway structure 78 of the plug-engagement portion 76 is mateably received by the elongated key structure 66 of the adjustment plug 60, and the serrations 79 of the body-engaging portion 77 are received by the locking plate-engagement serrations 87 of the upper generally circular member 13 such that the adjustment plug is locked in position. Referring to FIGS. 2B, 2C, 17 and 21, during assembly of the second embodiment, the locking plate 80 is fitted coaxially over the upper end of the shaft 14, the elongated key structure 84 of the plug-engagement portion 81 is mateably received by the keyway structure 72 of the adjustment plug 67, and the serrations 86 of the body-engaging portion 85 are received by the locking plate-engagement serrations 87 of the upper generally circular member 13 such that the adjustment plug is locked in position.

Figure 3A:
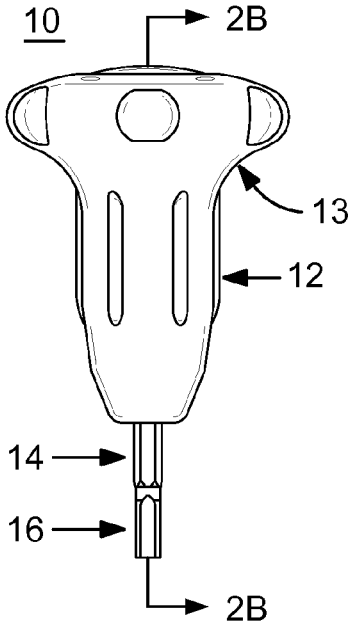
FIG. 3A is a front elevational view of a lockable torque-limiting driver.
Figure 3B:
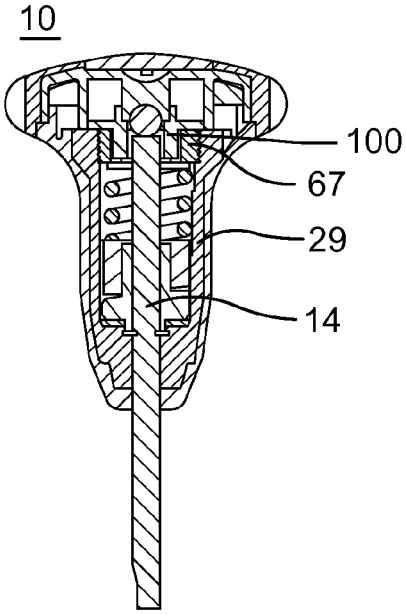
FIG. 3B is a sectional view of the driver taken generally along the line 3B-3B in FIG. 3A showing a third embodiment of the locking mechanism.
Figure 3C:
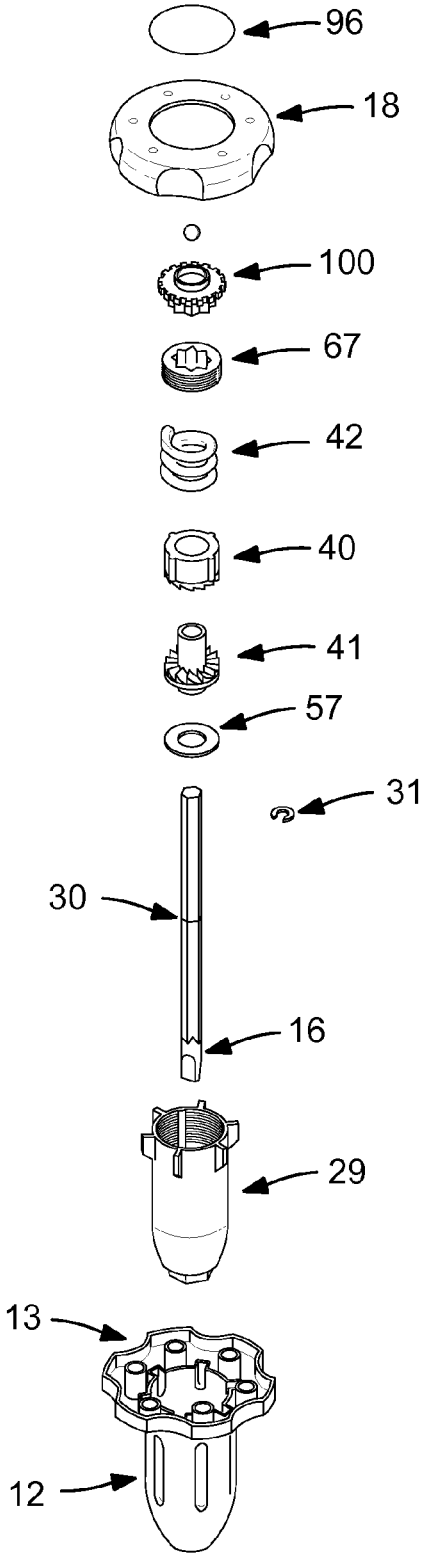
FIG. 3C is an exploded view of the driver of FIG. 3A.
Figure 4:
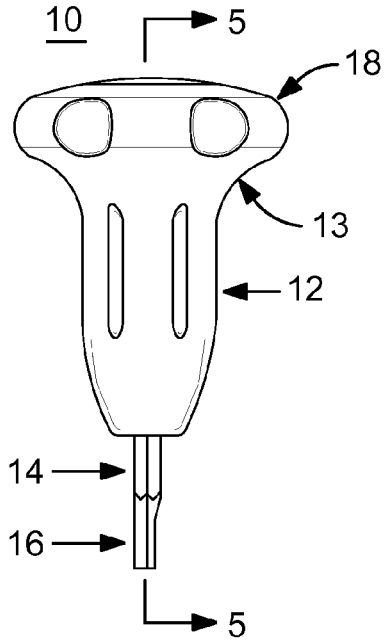
FIG. 4 is a 90° side elevational view of the driver of FIG. 1A.
Figure 10:
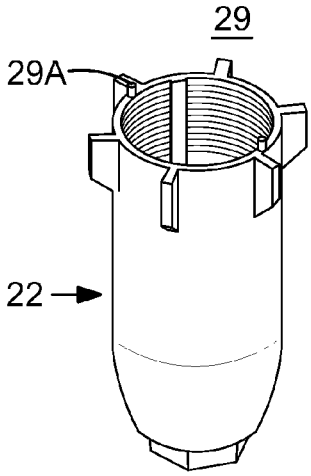
FIG. 10 is perspective view of the sleeve of FIG. 3C.
Figure 11A:
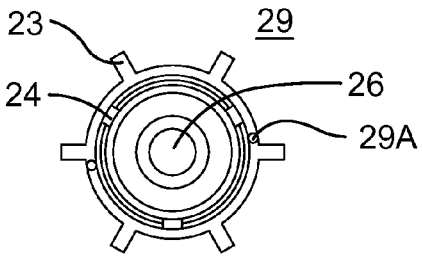
FIG. 11B is a side elevational view of the sleeve in FIG. 10.
FIG. 11C is a 90° side elevational view of the sleeve in FIG. 11B.
FIG. 11D is a sectional view of the sleeve taken generally along the line 11D-11D in FIG. 11C.
Figure 11B:
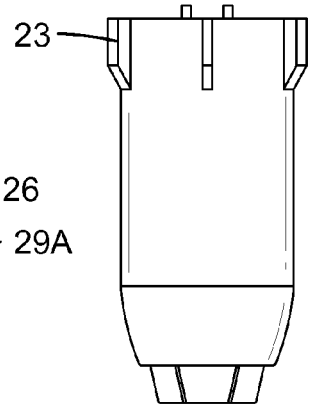
Figure 11C:
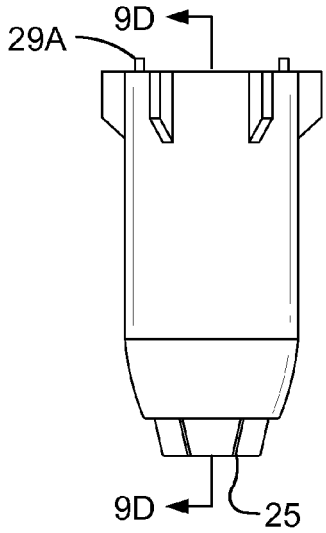
Figure 11D:
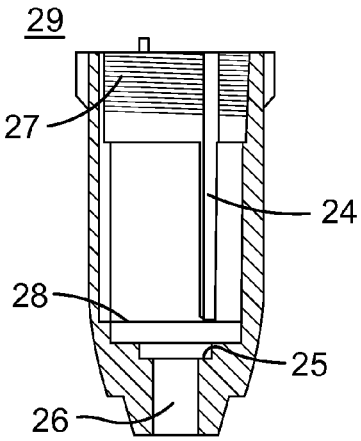
Figure 22:
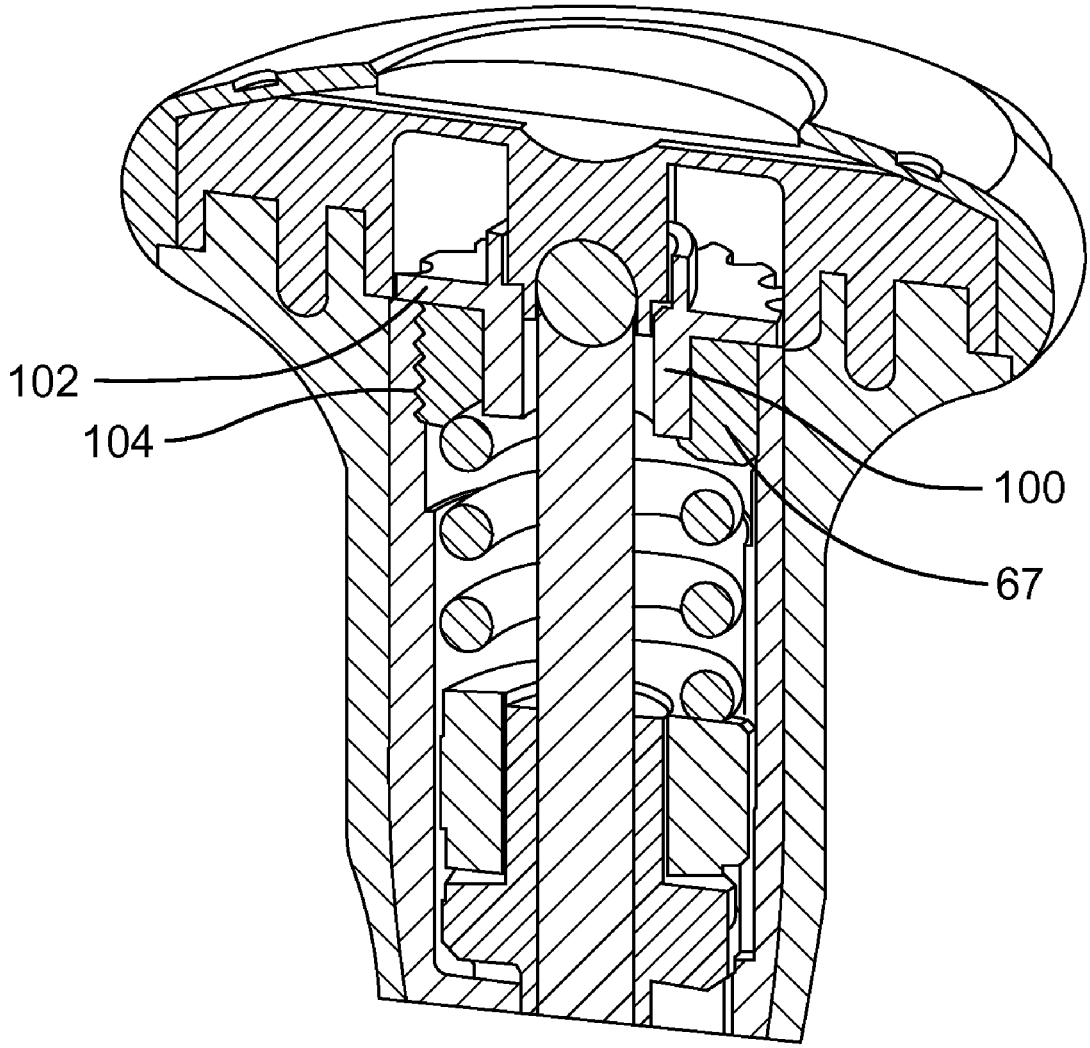
FIG. 22 is a fragmentary sectional view along the line similar to the view in FIG. 5 showing the third embodiment of the locking mechanism of the driver of 3B.
Figure 23A:
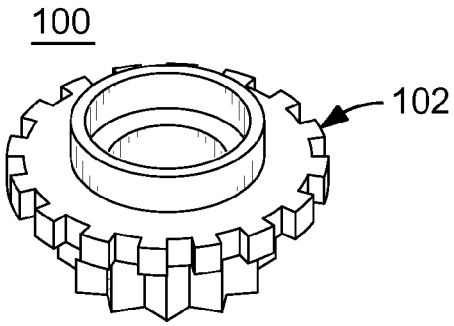
FIG. 23A is an perspective view of the locking plate of FIG. 3C.
Figure 23B:
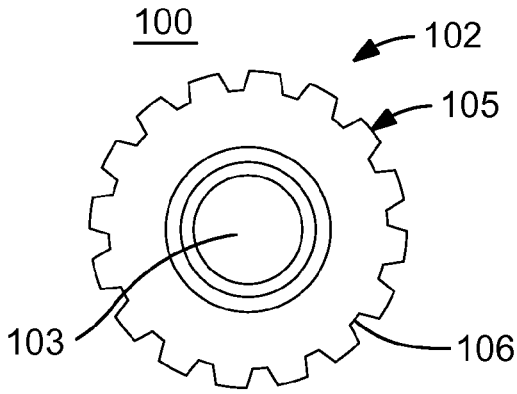
FIG. 23B is a top plan view of the locking plate of FIG. 3C.
Figure 23C:
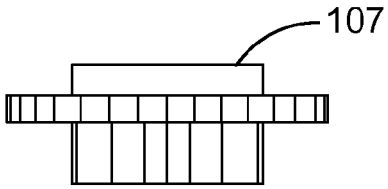
FIG. 23C is a side elevational view of the locking plate of FIG. 3C.
Figure 23D:
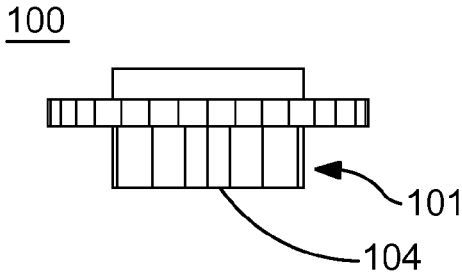
FIG. 23D is a 90° side elevational view of the locking plate of FIG. 23C.
Figure 23E:
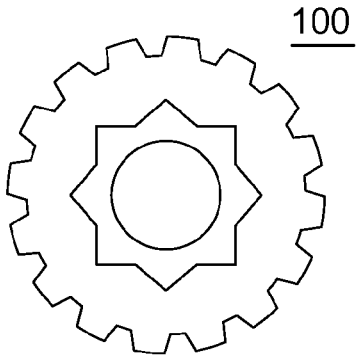
FIG. 23E is a bottom plan view of the locking plate of FIG. 3C.
Figure 24:
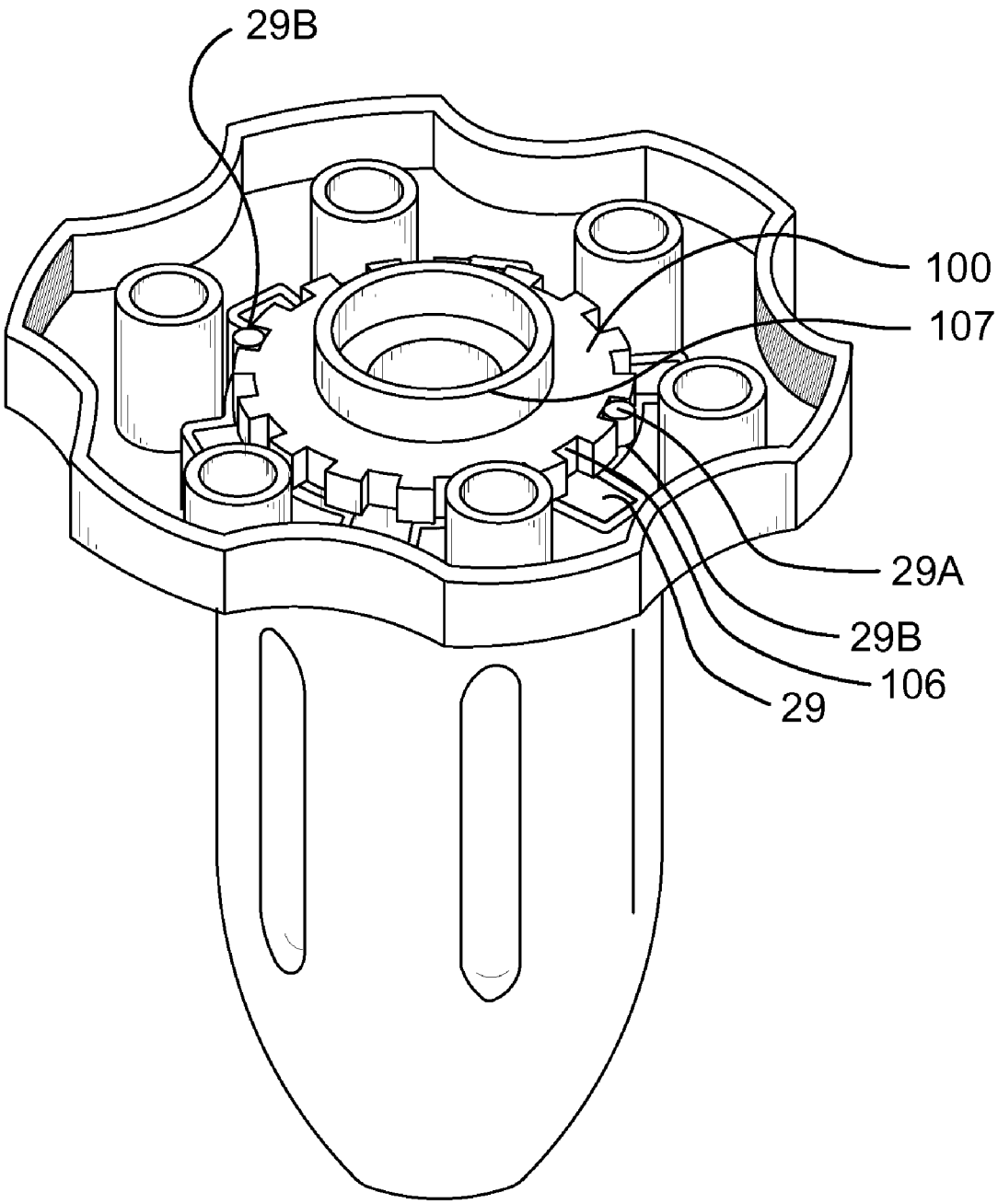
FIG. 24 is a perspective view showing the locking mechanism of the driver of FIG. 3B.

The preferred embodiment of the driver 10 is shown in FIGS. 3A-3C. Referring to FIGS. 3B and 3C, the driver includes a third embodiment of the torque-locking means which comprises a locking plate coupled with the adjustment plug and the sleeve to prevent the inadvertent movement of the adjustment plug. The third embodiment of the locking means utilizes the adjustment plug 67 previously shown in FIGS. 2B, 17 and in particular FIGS. 18-18D. To restate briefly, the adjustment plug 67 has an annular body 68 with an externally threaded surface 69, a lower end face 70, an upper end face 71, and a keyway structure 72 therethrough, in this embodiment, an octagonal bore. Referring to FIGS. 3B and 3C, during assembly, the adjustment plug 67 is fitted coaxially over the upper end of the shaft 14, and threadedly engaged in the upper open end of the sleeve 29, for bearing against the upper end of the compression spring 42. Sleeve 29 is similar to the sleeve 21 previously described, but includes a pair of prongs 29A located on opposite sides of the upper open end of the sleeve (FIGS. 10-11D). The locking plate utilized in the third embodiment of the torque-locking means is shown in FIGS. 3B, 3C, and in particular FIGS. 23A-23E. The locking plate 100 is generally gear shaped and includes an adjustment plug-engaging portion 101, a sleeve engaging portion 102, an annular cap-receiving portion 107, and a cylindrical bore 103 formed axially therethrough. The plug-engaging portion 101 is characterized by an elongated key structure 104, in this embodiment, an eight point star formation to mateably receive the adjustment plug 67 (FIGS. 3B and 22). The sleeve-engaging portion 102 is characterized by gears 105 about its circumference with undulations 106 to mateably receive the locking plate-engagement portions 29B, which include prongs 29A on the upper end of the sleeve 29 (FIG. 24).

Referring to FIGS. 3B, 3C, 22 and 24, during assembly of the third embodiment, the locking plate 100 is fitted coaxially over the upper end of the shaft 14, the elongated key structure 104 of the plug-engagement portion 101 is mateably received by the keyway structure 72 of the adjustment plug 67, and the undulations 106 of the sleeve-engaging portion 102 are received by the locking plate-engagement prongs 29A on the upper end of the sleeve 29 such that the adjustment plug is locked in position.

To complete the assembly of the driver 10, a gripping means comprising a cap 18 with a grippable surface 95 and a cushion and/or label 96 (FIGS. 1A and 1C) is mounted to the generally circular member 13. During assembly, a ball bearing 33 is seated in the ball support 91 of the cap 18 (FIG. 17), and the cap is then fitted over the upper generally circular member 13, to a mounted position shown in FIGS. 5 and 17. In the mounted position, the ball bearing 33 is held against the bearing end face 32 of the shaft 14 and the location posts 92 (FIG. 17) are mateably received in the cap location bores 88 (FIGS. 12 and 17). The cap may be snap-fitted to the generally circular member 13, or fixed by sonic welding, solvent welding or the like. When the cap is fixed, the driver is permanently assembled with the torque setting locked in the desired position.

Figure 27:
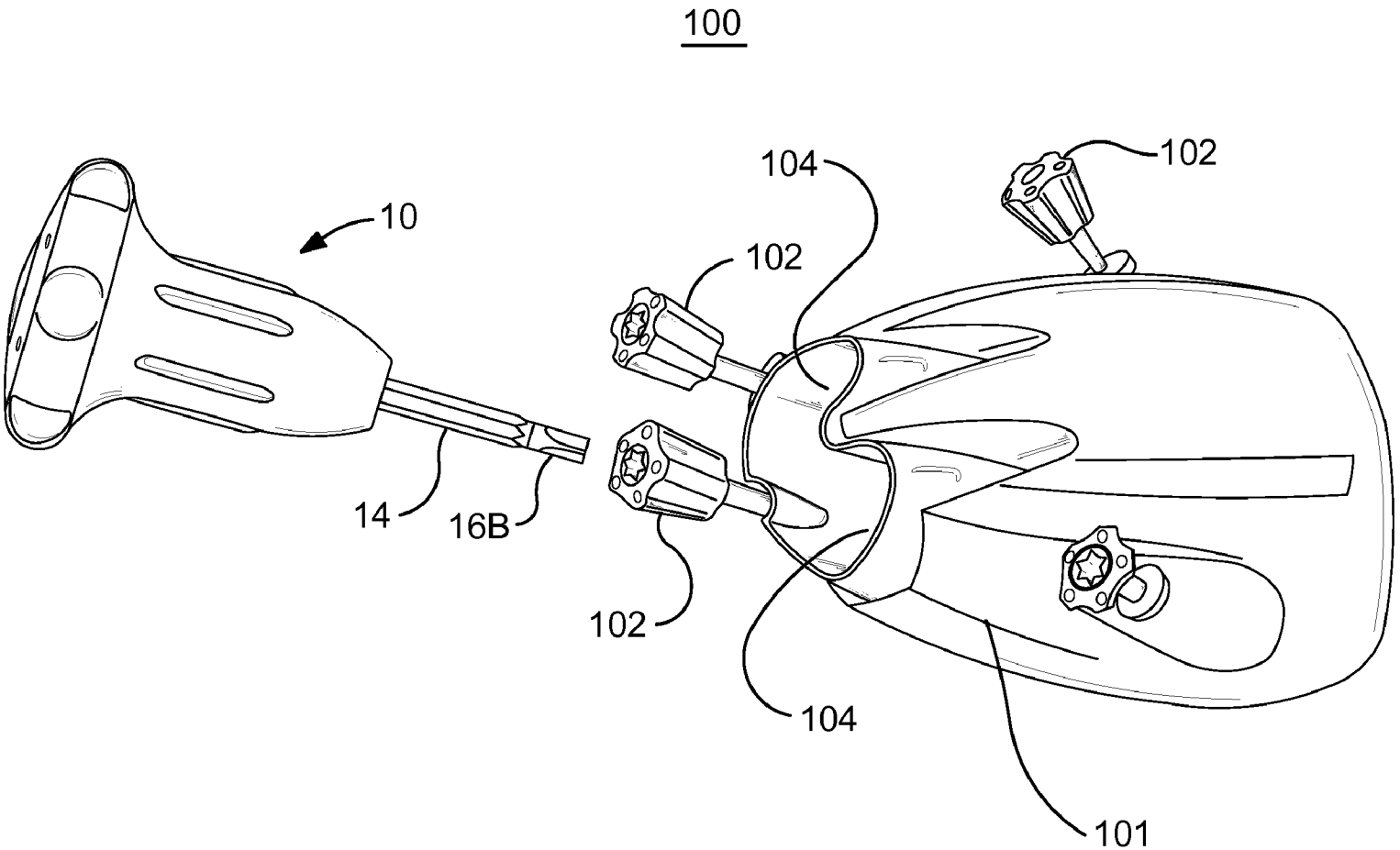
FIG. 27 is a perspective view showing a golf club weight attachment system.

Finally FIG. 27 shows a golf club weight attachment system 100 whereby a lockable torque-limiting driver 10 is locked at a desired torque setting as described above is used with a weight adjustable golf club 101 (as well known in the art) with weights 102 that are screwably attached at locations 104 on the club 101. The weights 102 are attached to the club 101 by inserting the weight-engaging tip 16A of the shaft 14 into the weights 102 and then screwably attaching them at locations 104 (at the desired torque setting) so that the desired weight characteristics of the club are realized. See below for a detailed description of the operation of the driver 10.

Figure 25:
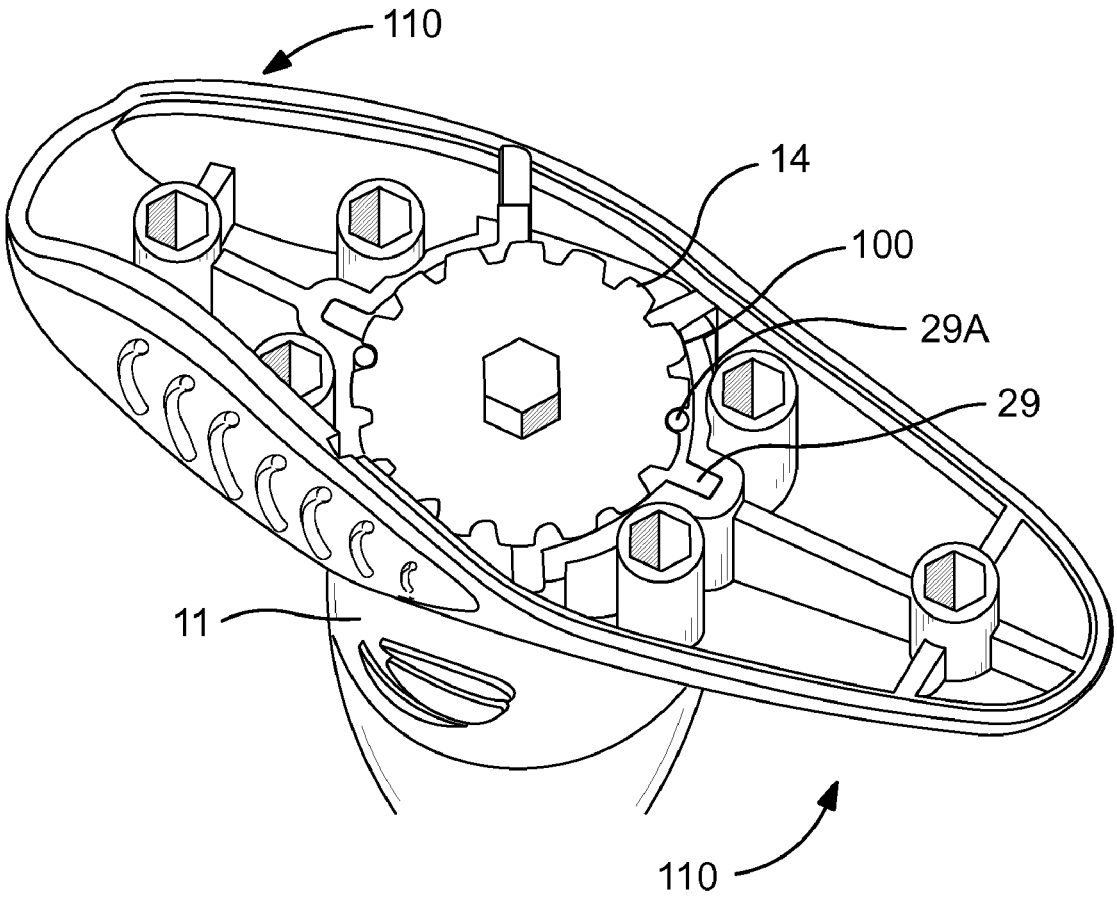
FIG. 25 is an additional embodiment of the driver of FIG. 24 showing the locking mechanism of the driver of FIG. 3B used in a T-shaped driver.
Figure 26:
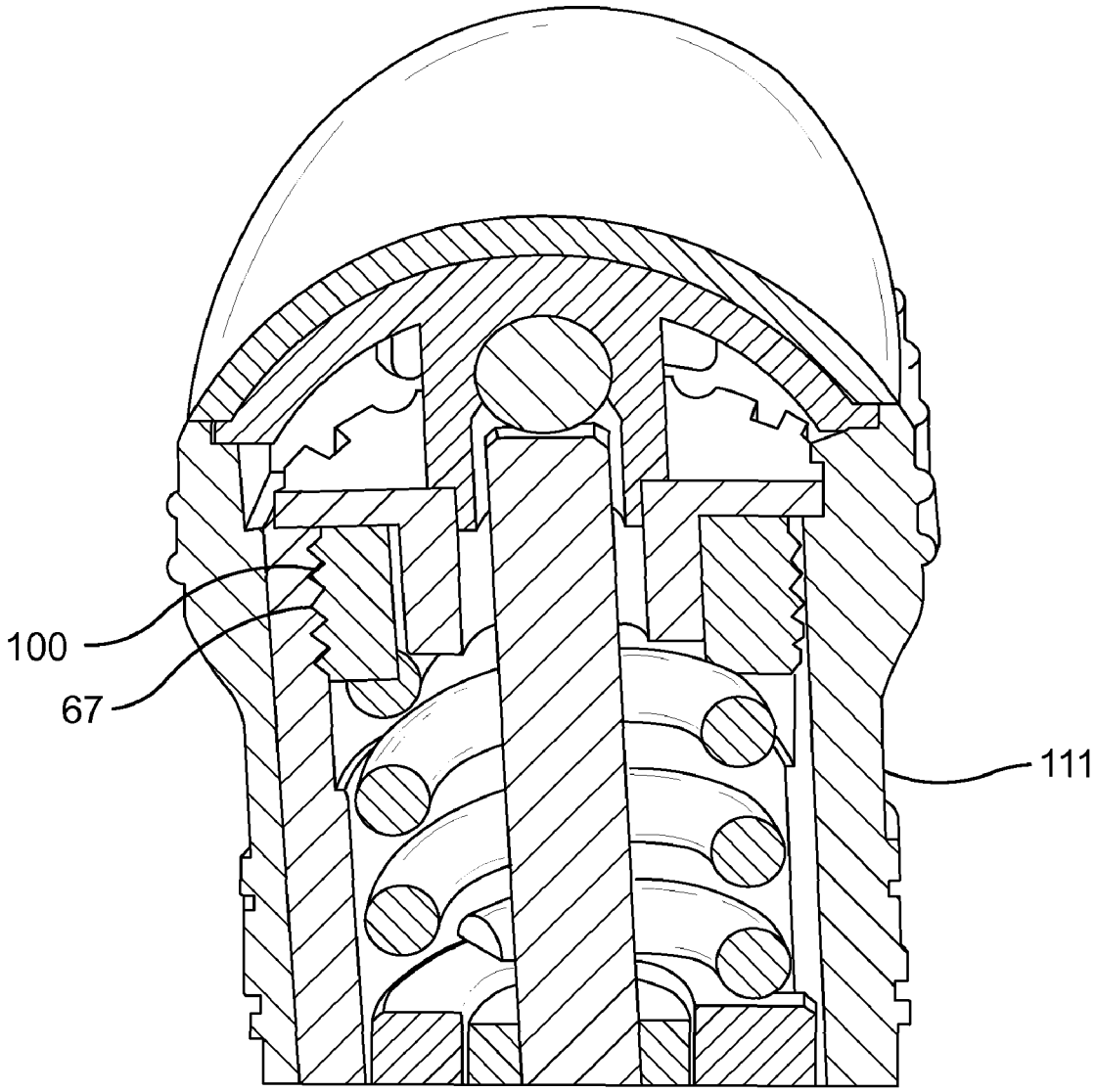
FIG. 26 is a sectional view of the driver in FIG. 25.

Operation of the driver 10 is accomplished by the taking the cap 18 into the user's hand such that the palm rests on the upper surface of the cap and the fingers rest within the grippable surface 95. In addition to the generally circular driver previously described, the driver 10 may also be substantially T-shaped, and example of which is shown in FIGS. 25 and 26. For the T-shaped embodiment, it will be appreciated that the inner workings are the same as previously described for the generally circular embodiment and, in operation, the arms 110 of the driver may be rested in the palm of the user's hand, with the fingers wrapped beneath the arms and straddling the stem portion 111. When the driver in either embodiment is rotated in one direction, the shaft 14 will rotate with the body 12 until the desired torque level is reached, at which point the biasing force exerted by the spring 42 is overcome to allow the sloping faces 46 of the upper cam 40 to slide up the sloping faces 54 of the lower cam 41 for the angular distance of one tooth, at which point the upper cam 40 will snap into engagement behind the next tooth of the lower cam 41, thereby provide the user a tactile and/or audible indication that the desired torque has been reached.

In the construction of the driver 10, a majority of the components may be formed of suitable plastics that may be molded, however, components that must withstand load bearing, torsional, and other significant forces such as the retaining ring 31, spring 42, shaft 14 and ball bearing 33 may be formed of suitable metals. Based on the forgoing description and accompanying figures, it can be seen that there has been provided an improved lockable torque-limiting driver that allows for a fine range of torque setting such that it can be effectively locked into a variety of specific torque settings. It has also been shown that the driver can be produced at a low-cost and is suitable for mass production without sacrificing precision.

What is claimed is:

1. A method for locking a settable torque-limiting driver at a desired torque value comprising: providing a torque-limiting mechanism coupled to a shaft and housed within a sleeve which is further housed within a body; setting a torque-adjusting mechanism coupled to said torque-limiting mechanism, wherein the torque-adjusting mechanism comprises an adjustment plug; and, engaging the torque-adjusting mechanism with a torque-locking mechanism wherein the torque-locking mechanism engages the torque-adjusting mechanism and the body; wherein the torque-locking mechanism comprises a locking plate with an adjustment plug-engaging portion and a body-engaging portion.

2. The method of claim 1 wherein the torque-locking mechanism comprises a locking plate-engagement portion on said body.

3. The method of claim 2 wherein the torque-locking mechanism comprises said locking plate with said adjustment plug-engaging portion engaged with said adjustment plug and said body-engaging portion engaged with said locking plate-engagement portion on said body.

4. The method of claim 3 wherein the adjustment plug has a generally annular elongated key structure and the locking plate has a generally keyway diamond structure.

5. The method of claim 3 wherein the adjustment plug has a generally annular keyway structure and the locking plate has a generally key T-shaped structure.

6. A method for locking a settable torque-limiting driver at a desired torque value comprising: providing a torque-limiting mechanism coupled to a shaft and housed within a sleeve which is further housed within a body; setting a torque-adjusting mechanism coupled to said torque-limiting mechanism; wherein the torque-adjusting mechanism comprises an adjustment plug; and, engaging the torque-adjusting mechanism with a torque-locking mechanism, wherein the torque-locking mechanism engages the torque-adjusting mechanism and the sleeve, and wherein the torque-locking mechanism comprises a locking plate with an adjustment plug-engaging portion and a sleeve-engaging portion.

7. The method of claim 6 wherein the torque-locking mechanism comprises a locking plate-engagement portion on said sleeve.

8. The method of claim 7 wherein the torque-locking mechanism comprises said locking plate with said adjustment plug-engaging portion engaged with said adjustment plug and said body-engaging portion engaged with said locking plate-engagement portion on said sleeve.

9. The method of claim 8 wherein the adjustment plug has a generally annular keyway structure and the locking plate has a generally key gear-shaped structure.

* * * * *